United States Patent [19]

Edwards et al.

[11] 4,233,382

[45] Nov. 11, 1980

[54] ELECTROSTATIC TRANSFER OF MAGNETICALLY HELD TONER IMAGES

[75] Inventors: Donald W. Edwards, Wilmington; Emery J. Gorondy, Rockland, both of Del.

[73] Assignee: E. I. Du Pont de Nemours and Company, Wilmington, Del.

[21] Appl. No.: 955,506

[22] Filed: Oct. 27, 1978

Related U.S. Application Data

[63] Continuation of Ser. No. 767,511, Feb. 14, 1977, abandoned, which is a continuation-in-part of Ser. No. 672,551, Mar. 31, 1976, abandoned.

[51] Int. Cl.[2] ..... G03G 19/00

[52] U.S. Cl. ..... 430/39; 346/74.1

[58] Field of Search ..... 427/18, 47, 24; 346/74.1; 430/39

[56] References Cited

U.S. PATENT DOCUMENTS 4,146,898 3/1979 Nelson ..... 346/74.1

OTHER PUBLICATIONS

*Webster's Seventh New Collegiate Dictionary,* p. 883.

*Primary Examiner*—James R. Hoffman

[57] ABSTRACT

A process for reproducing graphic information wherein a magnetic image is formed in a premagnetized layer of acicular chromium dioxide by heating the chromium dioxide selectively to above its Curie point. Uncharged ferromagnetic toner particles are then applied uniformly to the chromium dioxide layer, but adhere only in the magnetized areas. The toner particles are then transferred electrostatically to a substrate.

18 Claims, 7 Drawing Figures

ELECTROSTATIC TRANSFER OF MAGNETICALLY HELD TONER IMAGES

CROSS-REFERENCE TO RELATED APPLICATIONS

This application is a continuation of Ser. No. 767,511 filed Feb. 14, 1977, which in turn is a continuation-in-part of Ser. No. 672,551, filed March 31, 1976, both now abandoned.

BACKGROUND OF THE INVENTION

Field of the Invention

The present invention relates to a process for dry printing of information. The process involves forming a magnetic image on a master followed by decorating the magnetic image with ferromagnetic toner particles which are then electrostatically transferred to a substrate capable of maintaining a charge and fixed in place.

Description of the Prior Art

Both Xerography and magnetography are known. Xerography involves: forming an electrostatic charge on a photoconductive material such as selenium; imagewise exposing the photoconductive material to light whereby the exposed areas lose their charge; and applying a pigmented, finely divided, electrically charged powder which is attracted to and held on the electrostatic image. The charged toner image is then transferred to copy paper either with an opposite electrostatic charge or by means of pressure.

In magnetography a magnetic image is formed, and ferromagnetic particles applied thereto which adhere to the magnetized areas of the image. The particles are then transferred to copy paper either by pressure or magnetically. The pressure technique causes objectionable wear to the imaging member and can also cause buildup of a film on the imaging member which causes smudging.

In magnetic transfer it has been found difficult to effect transfer of toner without erasing the latent magnet image on the imaging member.

SUMMARY OF THE INVENTION

The present invention relates to forming a latent magnetic image, decorating the latent magnetic image with a uncharged ferromagnetic toner, and then transferring the toner to a substrate electrostatically whereby the problems of pressure or magnetic transfer are overcome. By uncharged toner we mean toner which has not purposely been charged by means such as corona or triboelectric means but which may contain small triboelectric charges of either polarity.

DESCRIPTION OF THE DRAWINGS

FIGS. 3–7 show the stepwise formation of the latent magnetic image, the decoration thereof with toner, the transfer of the toner to the copy paper, and the fusion of the toner to the copy paper.

Figure 3:
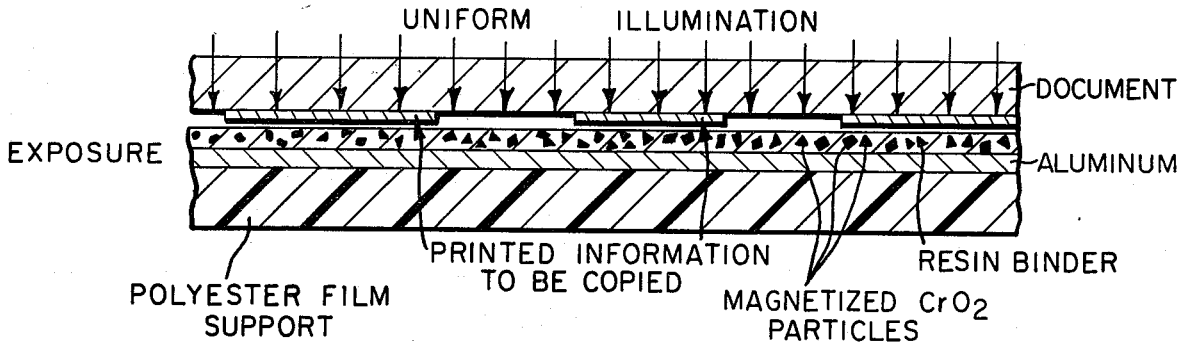
FIG. 3 is a diagram of the exposure of the magnetic master by radiant energy.
Figure 4:
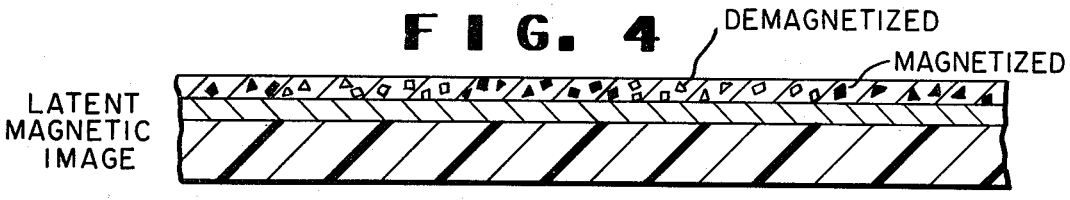
FIG. 4 is a diagram of the latent magnetic image.
Figure 5:
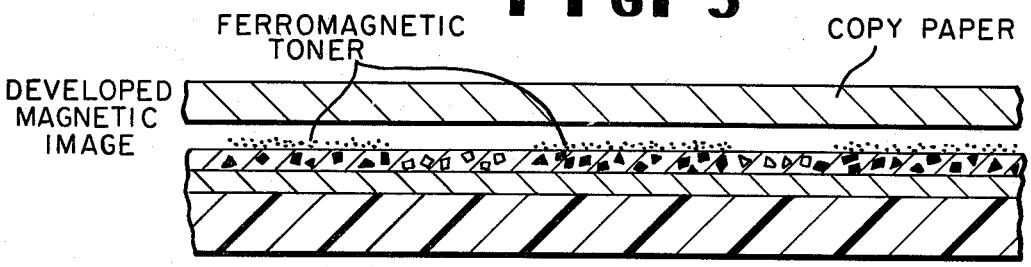
FIG. 5 is a diagram of the toned magnetic image superposed adjacent the copy paper.
Figure 6:
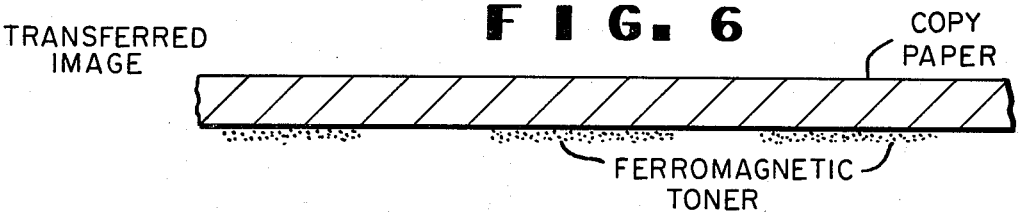
FIG. 6 is a diagram of the copy paper decorated with the transferred image.
Figure 7:
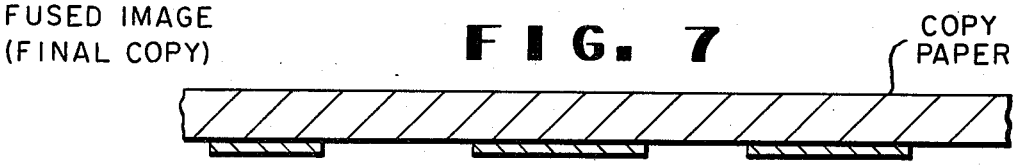
FIG. 7 is a diagram of the final copy decorated with the fused image.

An aluminized polyester film having a layer of periodically magnetized chromium dioxide particles in a binder adhered to the surface thereof which is to be used as a copying device is exposed to uniform illumination as shown in FIG. 3. As can be seen from FIG. 3 the printing on the document prevents the illumination from reaching the magnetized chromium dioxide particles, thus, leaving them magnetized in the areas under the printing. On the other hand, those areas of the document being copied which contain no printing do not prevent the illumination from reaching the magnetized chromium dioxide particles, thus heating them to above their Curie point of about 116° C., thus demagnetizing them. In this way the latent magnetic image shown in FIG. 4 is prepared. Ferromagnetic toner particles are applied to the latent magnetic image to form a developed magnetic image. Copy paper is brought into superposition with the magnetic image as shown in FIG. 5. A corona discharge device then electrostatically charges the back of the paper. Upon separation of the paper from the grounded drum an electrostatic force sufficient to overcome the magnetic attraction between the previously uncharged toner particles and the latent magnetic image is generated, thereby causing the toner particles to transfer to the copy paper and be adhered thereto with surprisingly high efficiency as shown in FIG. 6. Grounding is a means of preventing the accumulation of electrostatic charges on the surface of the drum, which may interfere with the printing process. This electrostatic transfer has no effect on the latent magnetic image which may be reused many times. The transferred toner particles are then fused to the copy paper as shown in FIG. 7 by heat.

The toner particles preferably are magnetic pigments encapsulated in a suitable binder. Generally the toner particles have an average size ranging from 10 to 30 microns with a preferred average size ranging from 15 to 20 microns. Spherical particles such as prepared by spray drying are preferred because of their superior flow properties which can be enhanced by the addition of minute amounts of a flow additive such as fumed silica. A further description of the preparation of toner particles may be found in U.S. Pat. No. 3,627,682. When using the apparatus disclosed herein the toner particles should have a low electrical conductivity. If the particles have high conductivity, they will be passed back and forth between the drum and the paper causing a diffuse image and low transfer efficiency. Generally the toner powder electrical conductivity is less than $1\times10^{-13}$ mho/cm. The ferromagnetic component can consist of hard magnetic particles or a binary mixture of hard and soft magnetic particles. The magnetically soft particles can be iron or another high-permeable, low-remanence material, such as certain ferrites, for example (Zn, Mn) $Fe_2O_4$, or permalloys. The magnetically hard particles can be an iron oxide, preferably $Fe_3O_4$, $\gamma$-$Fe_2O_3$, other ferrites, for example, $BaFe_{12}O_{19}$, chi-iron carbide, chromium dioxide or alloys of $Fe_3O_4$ and nickel or cobalt. A magnetically hard substance has a high-intrinsic coercivity, ranging generally from about 40 to about 40,000 oersteds and a high remanence (20 percent or more of the saturation magnetization) when removed from the magnetic field. Such substances are of low permeability and require high fields for magnetic saturation. A magnetically soft substance has low coercivity, for example, one oersted or less, high permeability, permitting saturation to be obtained with a small applied field, and exhibits a remanence of less than 5 percent of the saturation magnetization. A particularly preferred toner has an average particle size of 20 microns and contains 40 weight percent thermoplastic binder 30 weight percent $Fe_3O_4$ (magnetite) and 30 weight percent soft iron (carbonyl iron).

Figure 1:
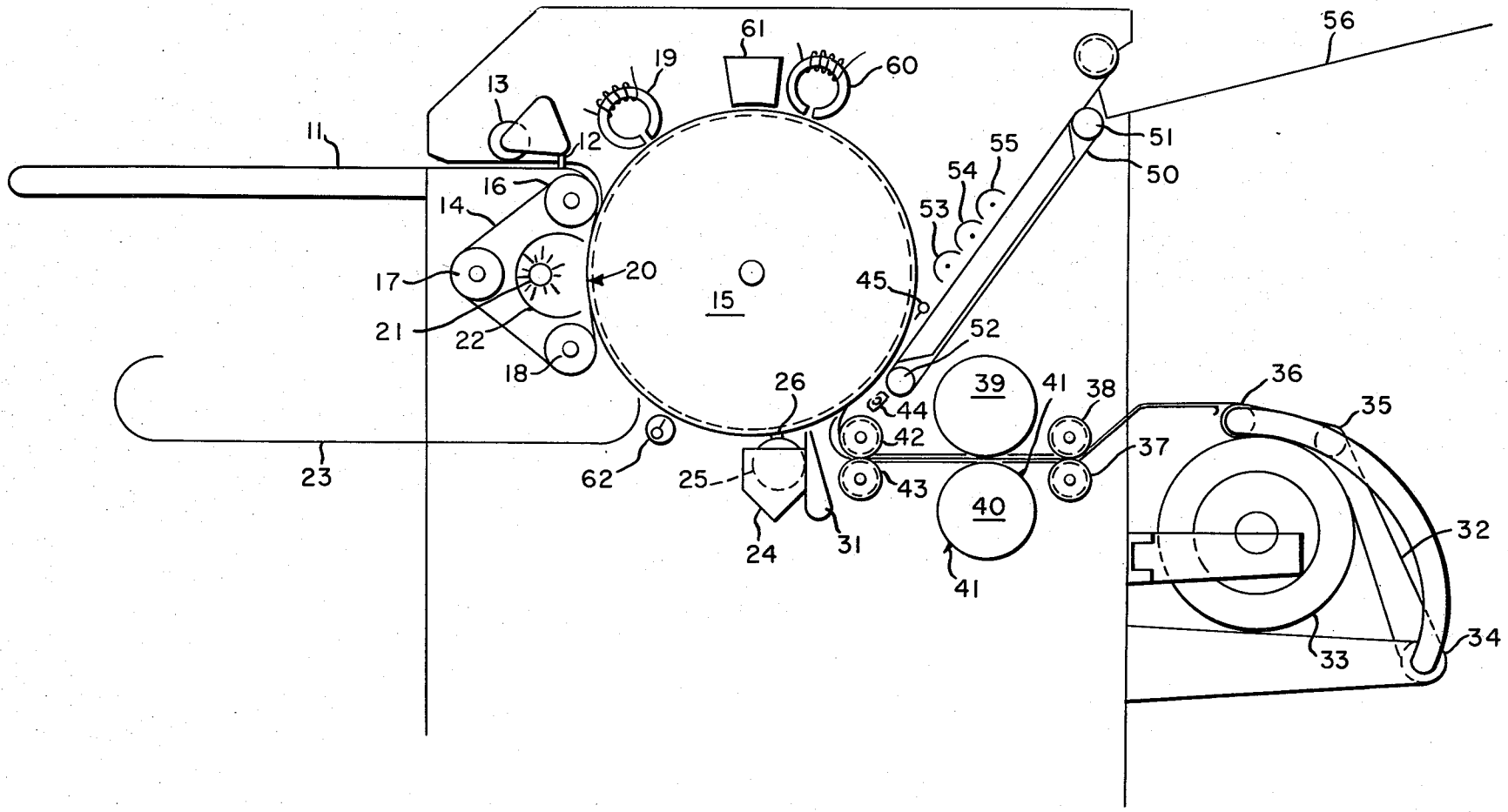
FIG. 1 is a schematic side view of a printer used to perform the process of the present invention.

Referring to FIG. 1, the document which is to be copied is placed on shelf 11 and urged against gate 12. The copier is then activated to lift gate 12 and lower feed roll 13 into contact with the document. Feed roll 13 feeds the document into the nip between endless belt 14 and drum 15. Endless belt 14 is made of a transparent film such as poly(ethylene terephthalate) about 2–7 mils in thickness. Rollers 16, 17, and 18 serve to drive and guide endless belt 14. The surface of drum 15 is preferably a poly (ethylene terephthalate) film about 5 mils in thickness. The convex surface of this film is coated with a conductive layer such as by being aluminized with a layer of aluminum to a surface resistivity of 1 to 1,000 ohms per square. The aluminum layer is grounded. The conductive support may also be a plastic such as polyoxymethylene sleeve coated with aluminum, nickel, copper or other conductive metal. The support may also be the conductive metal itself. The surface of the aluminum is coated with a layer of ferromagnetic material such as acicular chromium dioxide in an alkyd or other suitable binder. Generally the acicular chromium dioxide layer is from 0.001 to 0.012 mm in thickness and contains from 40 to 85 weight percent acicular chromium dioxide and from 15 to 60 weight percent alkyd or other suitable resin binder. Suitable acicular chromium dioxide can be prepared in accordance with the teachings of U.S. Pat. No. 2,956,955, issued Oct. 18, 1960, to Paul Arthur, Jr. However, the preferred acicular chromium dioxide particles are produced by the techniques disclosed in U.S. Pat. No. 2,923,683 and No. 3,512,930. Generally the chromium dioxide produced as disclosed in these patents consists essentially of uniform small acicular particles whose average length is $<1\mu$ with aspect ratios of $>6:1$, the said oxides containing from 58.9 to 61.9% chromium, and exhibiting an X-ray diffraction pattern which analysis shows to correspond in its entirety to a tetragonal structure having cell constants of $a_0=4.41\pm0.10$A and $c_O=2.90\pm0.10$A. The acicular chromium dioxide layer should have a resistivity of from about $1\times10^{-1}$ to $1\times10^{+9}$ ohm-cm which insures that any electrostatic charge imposed thereon will dissipate in less than a millisecond. The coating of the conductive support may be accomplished in a variety of ways, e.g., by gravure coating a slurry of $CrO_2$ and resin in tetrahydrofurancyclohexanone on a web of aluminized polyethylene terephthalate or by spray-coating a conductive metal sleeve, etc. It is preferred to orient the $CrO_2$ by passing the wet coated conductive support between the pole pieces of two bar magnets (approximately 1500 gauss average field strength) aligned with the same poles facing one another. The magnetic flux lines orient the acicular $CrO_2$ all in the same direction. Ratios of magnetic remanence to magnetic saturation (Br/Bs) of up to 0.80 with an intrinsic coercivity (iHc) of 510 to 550 oersteds have been achieved by this method.

Drum 15 rotates in a counterclockwise direction. The ferromagnetic coating on the drum is magnetized by premagnetizer 19, which records a spatial periodic pattern. We find 300 to 1000 magnetic reversals per inch on the magnetizable surface to be a working range and prefer about 400–600 magnetic reversals per inch. The technique of roll-in magnetization can be used to structure the $CrO_2$ surface, wherein a high permeability material such as nickel, which has been surface structured to the desired groove width is placed in contact with the DC magnetized $CrO_2$ surface. A permanent magnet or an electromagnet is placed on the backside of the permeable material. As the structured high permeability material is brought in contact with the $CrO_2$ surface, the nickel concentrates the magnetic flux lines at the points of contact resulting in the magnetization of the $CrO_2$ coating. The $CrO_2$ surface can also be thermoremanently structured by placing the continuously coated $CrO_2$ surface on top of a magnetic master recording of the desired periodic pattern. An external energy source then heats the $CrO_2$ surface above the Curie temperature. As the surface cools below the Curie point the periodic magnetic signal from the master film thermoremanently magnetizes it. As little as 20 oersteds can be used to structure the $CrO_2$ in this way, whereas over 200 oersteds are needed to apply detectable magnetism to the $CrO_2$ at room temperature. Also, a scanning laser beam may be used to structure a uniformly magnetized $CrO_2$ surface.

Alternatively, a film structured by grooves containing acicular chromium dioxide can be used for the surface of drum 15 in which case a simple DC magnet can be used as premagnetizer 19. Generally from 200 to 300 grooves per inch across the drum will be used giving 400 to 600 magnetic reversals per inch. Then the magnetized drum surface in contact with the document is moved past exposure station indicated generally at 20. The exposure station consists of lamp 21 and reflector 22. A suitable lamp 21 is a xenon flash, which has a color temperature equivalent to 6,000° C. The surface of drum 15 is exposed stepwise until the entire document has been recorded as a latent magnetic image on the surface of drum 15. The chromium dioxide as used herein has a Curie temperature of about 116° C. The printing of the document being copied shades the areas of the chromium dioxide over which such printing is situated during exposure thereby preventing their reaching the Curie point. Thus, after exposure, the surface of drum will have magnetized areas of chromium dioxide corresponding to the printed areas of the document being copied.

After exposure, the document being copied is dropped into tray 23.

The imagewise magnetized drum 15 is rotated past a toner decorator. The toner decorator comprises a trough 24 fitted with rapidly rotating roll 25, and bar 26. The toner is a fine powder of a magnetic material such as iron oxide encapsulated in a thermoplastic resin having a relatively low softening point of from 75° to 120° C. The toner generally will have an average particle size of from 10 to 30 microns. A vacuum knife 31 is used to remove whatever toner particles may have adventitiously become attached to the demagnetized areas of the chromium dioxide on the surface of drum 15.

The paper 32 on which the copy is to be made is fed from roll 33 around idler rolls 34, 35, and 36 to feed rolls 37 and 38. If desired, other substrates such as fabrics and films may be used rather than paper. Backing roll 39 cooperates with roll 40 equipped with cutting edges 41. Rolls 39 and 40 are activated by means not shown to cut the paper 32 to the same length as the length of the document being copied. The paper is then fed by feed rolls 42 and 43 into physical contact with the surface of drum 15. The paper 32 in contact with the surface of drum 15 is fed past corona discharge device 44. Corona discharge device 44 preferably is of the type known as a Corotron which comprises a corona wire spaced about 11/16" (17.5 mm) from the paper and a metal shield around about 75 percent of the corona wire leaving an opening of about 90° around the corona wire exposed facing the paper 32. The metal shield is insulated from the corona wire. The metal shield is maintained at ground potential. Generally the corona wire will be from 0.025 to 0.25 mm. in diameter and will be maintained at from 3,000 to 10,000 volts. The corona wire may be at either a negative, or a positive potential with negative potential being preferred. The corotron 44 electrostatically charges the back side of paper 32. This lightly pins the paper to the drum, and upon separation of the paper from the drum causes image-wise transfer of toner particles to paper 32. At the region in which paper 32 separates from the surface of drum 15 under the action of endless vacuum belt 50, the toner particles remain held in image-wise fashion to paper 32. We have observed that corotron 44 should be placed over the arc of intimate contact between the paper and the drum for best results. If corotron 44 is not so located or if there are forces present preventing the paper 32 from forming an arc of intimate contact, the resultant image becomes fuzzy. There is only a light amount of pressure between paper 32 and the surface of drum 15 (i.e., merely enough to hold them adjacent each other). The pressure between paper 32 and drum 15 is essentially entirely generated by the electrostatic attraction generated by corona discharge device or corotron 44. Nevertheless transfer efficiency is surprisingly high and approaches 100% for toners with nontacky surface characteristics and low conductivity. The paper 32 is then removed from the surface of drum 15 by the action of the vacuum belt 50 in conjunction with the action of puffer 45 that forces it onto the surface of endless vacuum belt 50 driven by rollers 51 and 52. Endless vacuum belt 50 transports paper 32 past infrared lamps 53, 54, and 55 which heat the thermoplastic resin encapsulating the ferromagnetic material in the toner particles causing them to melt and fuse to the paper 32. The decorated paper 32 is then fed into hopper 56.

When multiple copies of the same document are to be made, a control means, not shown, is so actuated that drum 15 is continuously rotated without activating demagnetizer 60, vacuum box 61, magnetizer 19 or lamp 21 because the electrostatic transfer of the toner particles does not affect the magnetic state in the chromium dioxide layer on the surface of drum 15. Many copies can be printed from a single exposure at speeds of up to 300 feet/minute. Over 10,000 copies from a single image have been demonstrated. Toner particles which do not transfer, may themselves become electrostatically charged in the transfer zone adjacent to the corotron 44. Subsequently, these particles will pick up other particles electrostatically and ultimately transfer these to produce unwanted markings. To prevent this, a static eliminator 62 is used. Conveniently, this is an AC corona discharge bar.

When it is desired to prepare copies from a different document image eraser 60, which conveniently can be a DC magnetic head in the case of continuously coated film, is activated and the chromium dioxide is uniformly magnetized. Whatever toner particles may be remaining on the previously magnetized areas of chromium dioxide, are removed by vacuum box 61 which preferably acts in conjunction with brushes. The chromium dioxide is then magnetized by magnetizer 19 to provide a periodic magnetic structure and the process described above repeated.

It is to be understood that substrates other than paper, such as cloth and dielectric films, can be used.

Figure 2:
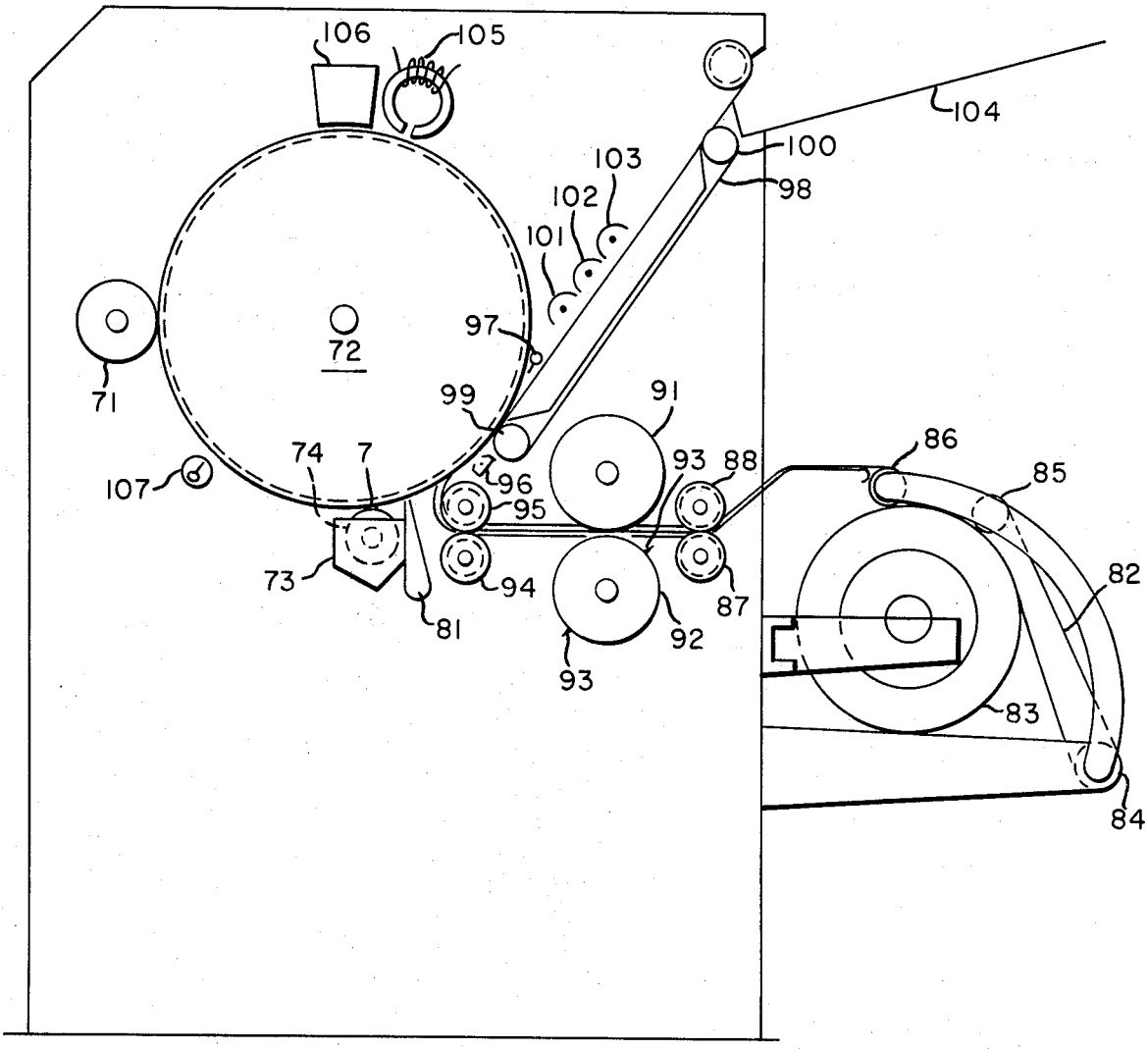
FIG. 2 is a side view of a printer equipped with a magnetic printing head used to perform the process of the present invention.

FIG. 2 shows an alternate form of printer using a magnetic printing head such as have been reviewed by W. H. Meiklejohn in A.I.P. Conference, Proc. (Pt. 2) 10, (1973) pages 1102 to 1114. In the example of FIG. 2 magnetic printing head 71 is used to form the latent image on the magnetic surface of drum 72 which has the same structure as drum 15 described above. Magnetic printing head 71 is a multitrack printing head such as have been developed for fixed head per track discs. Preferably track density will be about 200 magnets per inch which is adequate to print with good resolution. Generally the multitrack write head will be activated by head drivers which can be activated by a read-only memory character generator. The read-only memory character generator can respond to an information storage device such as a magnetic tape which may be part of the printer or remote therefrom. Alternatively, a keyboard can activate the multitrack write head, wherein magnetic structuring is accomplished with the magnetic write head. Toner particles which do not transfer may themselves become electrostatically charged in the transfer zone adjacent by the Corotron 96. Subsequently, these particles will pick up other particles electrostatically and ultimately transfer these to produce unwanted markings. To prevent this a static eliminator 107 is used. Conveniently, this is an AC corona discharge bar. The thus magnetized drum 72 is rotated counterclockwise past a toner slinger which comprises a trough 73 fitted with rapidly rotating rolls 74, and stationary bar 75. A vacuum knife 81 is used to remove whatever toner particles may have adventitiously become attached to the demagnetized areas of the chromium dioxide on the surface of drum 72.

The paper 82 to which the toner pattern is to be applied is fed from roll 83 around idler rolls 84, 85, and 86 to feed rolls 87 and 88. Backing roll 91 cooperates with roll 92 equipped with cutting edges 93. Rolls 91 and 92 are activated by means not shown to cut the paper 82 to the desired length. The paper is then fed by feed rolls into physical contact with the surface of drum 72. The paper 82 in contact with the surface of drum 72 is fed past corona discharge device or corotron 96 which electrostatically charges the back of the paper. Upon separation of the paper from the grounded drum an electrostatic force sufficient to overcome the magnetic attraction between the previously uncharged toner particles and the latent magnetic image is generated, thereby causing the toner particles to transfer to the copy paper and be adhered thereto. The paper 82 is then removed from the surface of drum 72 by the action of puffer 97 that forces it onto the surface of endless vacuum belt 98 driven by rollers 99 and 100. Endless vacuum belt 98 transports paper 82 past infrared lamps 101, 102, and 103 which heat the thermoplastic resin encapsulating the ferromagnetic material in the toner particles causing them to melt and fuse to the paper 82. The decorated paper 82 is then fed into hopper 104. The drum can be continuously rotated to make a plurality of copies.

When it is desired to make a different print, image eraser 105 is actuated to erase the latent magnetic image and vacuum box 106 is used to remove any toner particles remaining on the old latent magnetic image.

The process can also be operated using either a thermal stylus or an electrical stylus to create the latent magnetic image, the former by conductive heating and the latter by electrical resistance heating of the imaging layer. Either stylus can demagnetize selected areas by heating previously magnetized material above the Curie point or it can magnetize selected areas thermoremanently by allowing the heated imaging material to cool through its Curie point in the presence of a magnetic field. A field of 20 to 200 Oe adjacent to the stylus has been found to be sufficient for thermoremanent magnetization, while a much stronger field of at least 800 Oe is necessary to magnetize unheated chromium dioxide sufficiently. It is recognized, of course, that imaging with electromagnetic or thermal transducers onto a continuous coating with its surface magnetized with a DC magnet will require modulation consistent with establishing magnetic gradients for adequate toner attraction in magnetized image areas.

We claim:

1. A process comprising bringing a substrate capable of maintaining an electrostatic charge into superposed position and intimate contact with an image of uncharged toner particles which have an electrical conductivity of less than about $1\times10^{-13}$ mho/cm magnetically adhered to an electrically conductive magnetic imaging member having a resistivity of less than about $1\times10^{+9}$ ohm-cm which is adapted to dissipate an electric charge, and applying an electric field at this position whereby said toner particles adhere to said substrate upon separation of said substrate from said electrically conductive magnetic imaging member.

2. The process of claim 1 wherein the imaging member is grounded.

3. The process of claim 2 wherein the electric field is generated by applying an electrostatic charge to the side of the substrate away from the toner particles.

4. The process of claim 3 wherein the electric charge field is generated by spraying ions on the side of said substrate away from the toner particles.

5. The process of claim 4 wherein the toner particles are fused to the substrate by heat.

6. The process of claim 4 wherein the image of uncharged toner particles is held by magnetized acicular chromium dioxide.

7. A process comprising spatially periodically magnetizing a layer of acicular chromium dioxide particles in a binder which particles comprise from 40 to 85 weight percent of a layer from 0.001 to 0.015 mm thick which layer has a resistivity of less than about $1\times10^{+9}$ ohm-cm adhered to a grounded electrically conductive layer, bringing said layer of acicular chromium dioxide into superposed position with a document containing thereon indicia which are to be copied, uniformly illuminating said document so that radiant energy is transmitted through said document in the areas of said document not covered by indicia whereby the acicular chromium dioxide in the areas where it is illuminated is heated to above its Curie point and demagnetized while the areas of acicular chromium dioxide covered by the indicia contained on said document are not heated above their Curie point, applying uncharged toner particles which have a low electrical conductivity of less than about $1\times10^{-13}$ mho/cm and which comprise ferromagnetic material and a fixable material uniformly to the chromium dioxide layer whereby said toner particles adhere only to the magnetized areas of the chromium dioxide, maintaining said toner particles in the uncharged condition, superposing a dielectric substrate capable of maintaining an electrostatic charge in intimate contact with said acicular chromium dioxide layer, and applying an electric field while said substrate is positioned adjacent said layer of acicular chromium dioxide whereby said toner particles adhere to said substrate upon separation of said substrate from said layer of chromium dioxide.

8. The process of claim 7 wherein the electric field is generated by applying an electrostatic charge to the side of the substrate away from the toner particles.

9. The process of claim 8 wherein the electric charge is generated by spraying ions on the side of said substrate away from the toner particles.

10. The process of claim 9 wherein the substrate is paper.

11. The process of claim 10 wherein the toner particles are fused to the substrate by heat.

12. The process of claim 9 wherein the substrate is a fabric.

13. The process of claim 9 wherein the substrate is a dielectric film.

14. A magnetic printing apparatus for applying nonconductive ferromagnetic particles to selected areas of a substrate capable of maintaining an electrostatic charge comprising a movable electrically grounded magnetic imaging member containing selectively magnetized areas of ferromagnetic particles and non-magnetized background areas, which magnetic imaging member has a resistivity of less than about $1\times10^{+9}$ ohm-cm in both background areas and selectively magnetized areas, drive means to advance said imaging member, means adapted to apply ferromagnetic toner particles in the uncharged condition to said magnetic imaging member, means to bring said substrate into superposed position with and in intimate contact with said magnetic imaging member, means for generating an electric charge on the side of the substrate away from the toner particles where said magnetic imaging member is superpositioned against said substrate and means for removing said substrate from said magnetic imaging member.

15. The apparatus of claim 14 wherein said means for generating an electrical charge comprises means for spraying ions.

16. The apparatus of claim 14 wherein magnetic means are provided to selectively magnetize the movable magnetic imaging member.

17. The apparatus of claim 14 wherein electrical or thermal stylus means are provided to selectively magnetize at the points of contact of said stylus the movable magnetic imaging member.

18. The apparatus of claim 14 wherein electrical or thermal stylus means are provided to selectively demagnetize at the points of contact of said stylus areas of the movable magnetic imaging member.

* * * * *